US008887526B2

(12) United States Patent
Wilmer

(10) Patent No.: US 8,887,526 B2
(45) Date of Patent: Nov. 18, 2014

(54) EARRING SUPPORT DEVICE

(71) Applicant: Angela Maria Wilmer, Edgewater, MD (US)

(72) Inventor: Angela Maria Wilmer, Edgewater, MD (US)

( * ) Notice: Subject to any disclaimer, the term of this patent is extended or adjusted under 35 U.S.C. 154(b) by 0 days.

(21) Appl. No.: 13/972,146

(22) Filed: Aug. 21, 2013

(65) Prior Publication Data

US 2014/0102137 A1 Apr. 17, 2014

Related U.S. Application Data

(60) Provisional application No. 61/714,580, filed on Oct. 16, 2012.

(51) Int. Cl.
*A44C 7/00* (2006.01)

(52) U.S. Cl.
CPC .. *A44C 7/00* (2013.01); *A44C 7/009* (2013.01)
USPC ..... 63/14.4; 63/1.18; 63/12

(58) Field of Classification Search
CPC ..... A44C 1/00; A44C 7/00; A44C 7/004; A44C 7/006
USPC ..... 63/12, 13, 1.18, 14.1–4.4, 35, 201; 24/3.11, 3.12; D11/40, 42, 75, 76
See application file for complete search history.

(56) References Cited

U.S. PATENT DOCUMENTS

| | | | | |
|---|---|---|---|---|
| 511,952 | A * | 1/1894 | Hubash | 606/188 |
| 527,358 | A * | 10/1894 | Bonner | 24/707 |
| 1,419,021 | A * | 6/1922 | Cicerchi | 63/12 |
| 2,525,195 | A | 10/1950 | Austrin et al. | |
| 2,764,797 | A * | 10/1956 | Carson | 24/543 |
| 3,122,007 | A * | 2/1964 | Horland | 63/12 |
| 3,483,715 | A * | 12/1969 | Kettell | 63/14.4 |
| 4,783,974 | A | 11/1988 | Hernandez | |
| 4,974,430 | A * | 12/1990 | Turner | 63/12 |
| 5,044,176 | A * | 9/1991 | King | 63/12 |
| 6,003,333 | A * | 12/1999 | Stevens | 63/12 |
| 6,263,703 | B1 * | 7/2001 | Kenney | 63/14.1 |
| 6,568,212 | B2 | 5/2003 | Jacobs | |
| 6,978,639 | B2 * | 12/2005 | Underwood | 63/13 |
| 7,111,370 | B2 * | 9/2006 | Daniel | 24/705 |
| 2009/0100865 | A1 | 4/2009 | Van Guelpen | |
| 2009/0249832 | A1 * | 10/2009 | Masciovecchio et al. | 63/14.1 |

FOREIGN PATENT DOCUMENTS

DE 10306233 A1 * 12/2003

* cited by examiner

*Primary Examiner* — Victor Batson
*Assistant Examiner* — Abigail Morrell
(74) *Attorney, Agent, or Firm* — Daniel Boudwin; Global Intellectual Property Agency LLC

(57) ABSTRACT

The present invention describes an earring support device for relieving the tension caused by having large earrings hanging from a piercing for an extended amount of time. The support device has a set of clam-shell shaped earlobe guards that are hinged together and clipped onto an earlobe. The earring support device further has apertures that correspond with that of the ear piercing, wherein when the pin of the earring is placed through the earring support device apertures, the earring support device functions to distribute the forces applied by the earring more evenly through the earlobe. The clam-shelled halves of the earring support device cover an area from the piercing to the bottom of the earlobe, and thus further serves to mask the effects of prior extended wearing of heavy jewelry.

7 Claims, 2 Drawing Sheets

EARRING SUPPORT DEVICE

CROSS REFERENCE TO RELATED APPLICATION

This application claims the benefit of U.S. Provisional Application No. 61/714,580 filed on Oct. 16, 2012, entitled "Protectear." The above identified patent application is herein incorporated by reference in its entirety to provide continuity of disclosure.

BACKGROUND OF THE INVENTION

1. Field of the Invention

The present invention relates to earring support devices. More specifically the invention relates to and earring support device that distributes the weight of the earring throughout the device and earlobe instead of solely being supported by the tissue of the ear lobe.

Ears are pierced for both fashion and religious reasons and piercings are of the oldest known forms of body modification. Ear piercings are popular among both men and women, and nearly all portions of the ear have been pierced. The traditional and most popular location on the ear to become pierced is the earlobe, however, the earlobe offers the least support of any other part of the ear because it lacks a supporting cartilage. The earlobe is often the victim of tearing and stretching as a result of the weight of the jewelry and a lack of a supporting structure other than the piercing from which the jewelry hangs. The piercing of the earlobe may become permanently elongated, stretched out, or otherwise badly deformed. Having deformed piercings creates a look that is not aesthetically pleasing and the elongation of the piercing will become worse with continued wearing of heavy earrings.

There are several ear piercing support devices that provide support attachments onto earrings. These attachments are adapted to relieve some of the pressure applied on the earlobe by providing additional support around the ear in order to enable the ear piercing to withstand the weight of the jewelry. The drawback of these systems is that they are often bulky and provide support by wrapping around the periphery of an ear. These systems tend to be uncomfortable and not as decorative as the jewelry that it is designed to support.

Some devices also attempt to relieve pressure caused by the jewelry by enabling a breakage from the piercing when a sufficient pressure is achieved. The drawback of these devices is that they rely on separation only after an exceeding pressure is achieved. The problem with these devices is that they fail to resolve or relieve the long term effects of a heavy earring hanging from the earlobes and only provide a breakage as a result of the earring being forcefully pulled off.

There are several devices that relieve a pressure on the earlobes caused by heavy jewelry; however none of the devices of the past address the need for distributing the weight of the jewelry over the area of the earlobe without adding the bulkiness that comes with devices that wrap around the ears.

The present invention relates to a new and improved earring support device configured designed to distribute the weight applied to the piercing by the earring. The support device comprises a set of clam-shell shaped earlobe guards that are joined together by a hinge. The guards clamp on either side of the earlobe and are secured thereto. The guards each comprise an aperture extending from the upper portion of the guard and are adapted to align with an ear piercing. After the earring support device is clamped onto the earlobe, the earring is then inserted a first guard, through the ear piercing, and exits through the opposing ear piercing guard. When the earring is inserted through the clam-shell shaped guards, the weight of the jewelry is supported by the device, which is clamped onto the earlobe and is no longer supported by just the ear piercing. The present invention further serves to conceal any prior damage from the extended wearing of heavy jewelry, and additionally the earring support device comes in a variety of designs and colors that can be color coordinated with the jewelry.

2. Description of the Prior Art

Devices have been disclosed in the prior art that relate to earring support structures. These include devices that have been patented and published in patent application publications. These devices generally relate to support devices that wrap around the ear and earrings that separate from the earlobe after a separating force is applied to the jewelry. The following is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 2,525,195 to Austrin describes a safety guard for ear ornaments. In use, the majority of the device wraps around the back of the ear and only the decorative spiral hook portion is exposed on the outer side of the user's ear. The exposed portion of the device is attached to and supports the earring by providing a hanger for the ear ornaments. The prior art of Austrin, however, differs from the present invention in that it fails to provide a non-bulky device that is not required to be wrapped around the majority of the ear.

U.S. Pat. No. 4,783,974 to Hernandez describes a detachable earring ornament. The earring assembly comprises male and female attachments wherein the male connector is readily connectable to a variety of earring ornaments. The detachable earring ornament is further configured to become separable if a force is applied to the jewelry by being grabbed or caught onto an object. Although the prior art of Hernandez is similar in nature and relevant to the present invention, the prior art differs in that it only provides a separation in the event of a force on the jewelry, and fails to offer a solution to the effects upon a pierced ear by the wearing of heavy jewelry for an extended amount of time.

U.S. Pat. No. 6,568,212 to Jacobs discloses ear jewelry comprising a decorative wire that generally conforms to the periphery of an ear. The wires comprise supports near its upper and lower ends, wherein the lower end support takes the form of a pin that is inserted through a pierced hole in the earlobe. While the prior art of Jacobs is similar in nature and relevant to the present invention, it differs in that it fails to provide a non-bulky device that is not wrapped around the periphery of the ear.

U.S. Pat. No. 7,275,396 to MacHock describes an apparatus for the support of an earring. The support device is adapted for use with pierced, screw-post, or clip-on earrings and reduces the stresses exerted on the earlobes; wherein the support device is adapted to encircle a user's ear to support an earring that is suspended from the user's earlobe. Although the prior art of MacHock is similar in nature and relevant to the present invention, it differs in that it is configured to be wrapped around the ear to provide support.

U.S. Patent Publication No. 2009/0100865 to Guelpen describes an apparatus for concealing the appearance of stretched ear piercings that come as a result of wearing heavy earrings. The invention comprises a decorative accessory that covers a stretched piercing. An earring is threaded through a hole of the piercing covering element, through the piercing, and connected with a rubber guard at the opposite side of the ear. While the prior art of Guelpen is similar in nature and relevant to the present invention, if differs in that it fails to provide a solution to the stretching of piercing holes, but instead attempts to conceal the problem after it has already occurred.

The present invention relates to a new and improved earring support device that relieves the pressure on a piercing caused by the prolonged wearing heavy jewelry. Specifically the earring support device acts by providing a clam-shell shaped hinged device that clamps onto a bottom portion of the earlobe, and further comprises holes on each clam-shelled side that are configured to align with an existing piercing in a user's ear. The support device allows for a distribution of the forces exerted by the jewelry to be spread evenly throughout the area occupied by the device on the earlobe, and thus relieves and removes the forces that are capable of damaging a piercing hole.

In view of the aforementioned shortcomings of the prior art devices, it is shown that the prior art has several known drawbacks and that the present invention is substantially divergent in design elements from the prior art and consequently it is clear that there is a need in the art for an improvement to existing earring support devices. In this regard the instant invention substantially fulfills these needs.

SUMMARY OF THE INVENTION

In view of the foregoing disadvantages inherent in the known types of earring support devices now present in the prior art, the present invention provides a new support device wherein the same can be utilized for providing convenience for the user when support of an earring is desired while not requiring a device to be wrapped around the ear.

The earring support device is designed for those who want to protect their piercings from becoming stretched out because of the weight of their decorative jewelry. The earring support device comprises a clam-shelled design that clamps onto the bottom of the earlobe and provides a set of apertures for the insertion of the pin of an earring.

In addition to providing support for heavy jewelry, the earring support device further serves an additional purpose of masking the effects of prior use of heavy jewelry. The extended wearing of heavy jewelry can cause the piercing to expand and resemble an elongated slit, which is not aesthetically pleasing. The clam-shell shaped halves of the earring support device cover an area from the piercing to the bottom of the earlobe and therein conceal the elongated piercing. Therefore the present invention duly serves to both mask and protect earlobes from the effects of heavy jewelry.

It is therefore an object of the present invention to provide a new and improved earring support device that has all of the advantages of the prior art and none of the disadvantages.

It is another object of the present invention to provide a support device that clamps onto an earlobe.

Another object of the present invention is to provide an earring support device that distributes the force that jewelry applies on an ear piercing.

Yet another object of the present invention is to provide a device that conceals the effects of the extended wearing of heavy jewelry.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
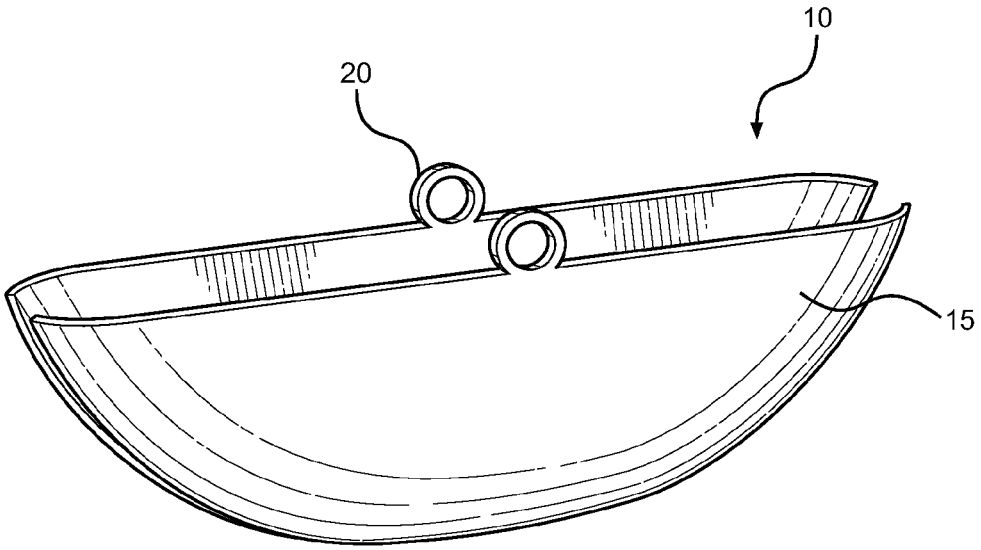
FIG. 1 illustrates a perspective view of the preferred embodiment in a closed state.

Reference is made herein to the attached drawings. Like reference numerals are used throughout the drawings to depict like or similar elements of the earring support device. For the purposes of presenting a brief and clear description of the present invention, the preferred embodiment will be discussed as used for the support, protection, and concealment of the effects of wearing heavy jewelry for an extended amount of time. The figures are intended for representative purposes only and should not be considered to be limiting in any respect.

Referring now to FIG. 1, there is shown a preferred embodiment of the earring support device of the present invention. The earring support device 10 comprises a set of clam-shell shaped earlobe guards, earring connection apertures, and a connecting spring hinge. The clam-shell shaped earlobe guards 15 are adapted to be affixed onto the earlobe at a position where the apertures 20 of the earring support device 10 align with an ear piercing of a user. The shells 15 are clamped on either side of the lower earlobe, trapping the earlobe therein by the force of an inner hinge.

Figure 2:
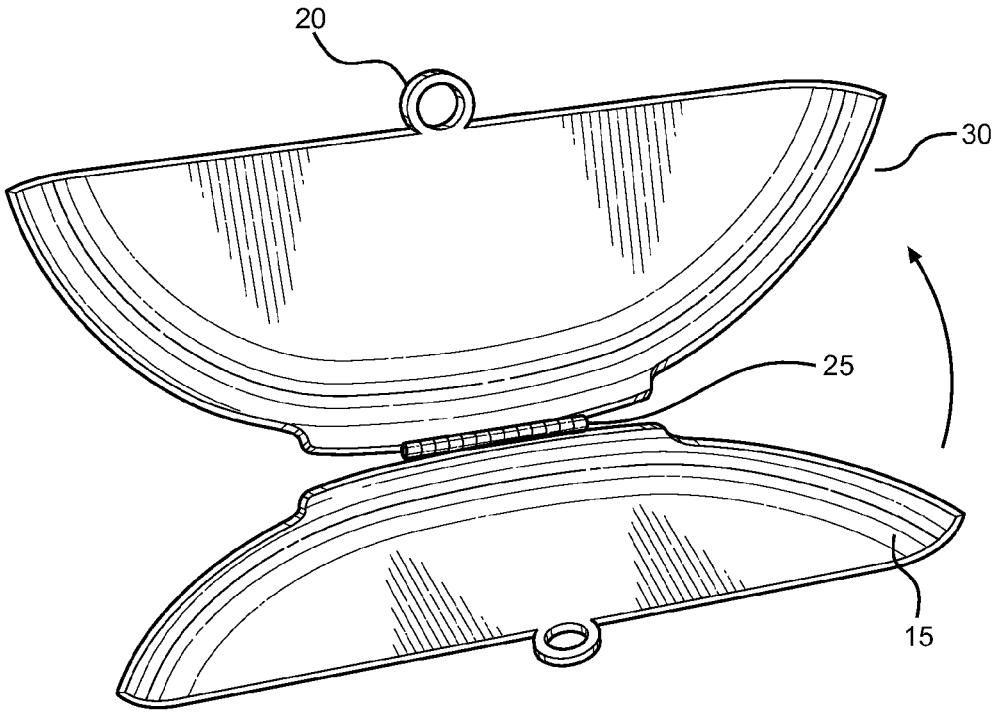
FIG. 2 illustrates a perspective view of the preferred embodiment of the present invention in an opened state.

Referring to FIG. 2, there is shown an opened view of the preferred embodiment. The earring support device 10 having a set of earlobe guards 15, apertures 20 and a central hinge 25 is illustrated. The hinge 25 is located on the inside of the support device 10, whereby the clam-shell shaped guards 15 are biased towards each other and are secured at a connection 30 between the two halves 15. Having the hinge 25 located inside of the earring support device additionally provides a more even and aesthetically appealing design.

Figure 3:
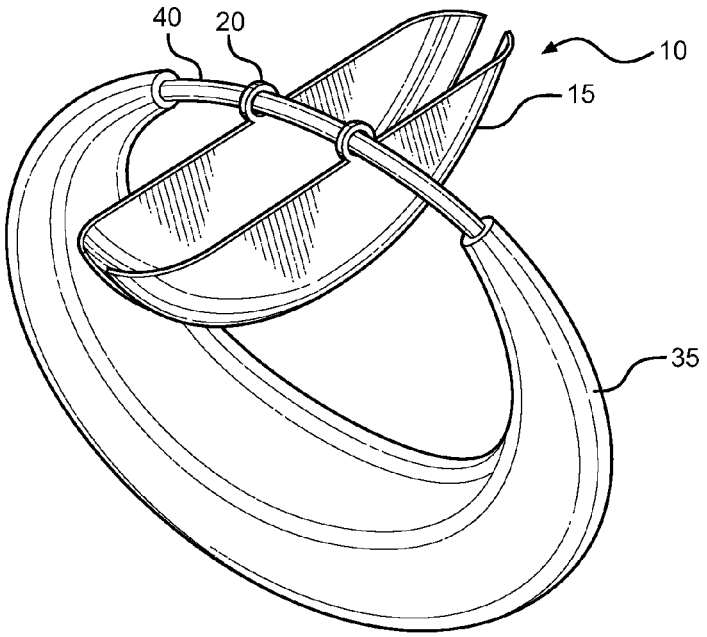
FIG. 3 illustrates a perspective view of the present invention in use with an earring.

Referring to FIG. 3, there is shown the preferred embodiment in use with an earring. Apertures 20 are disposed along upper edges of each half clamshell and extend upward therefrom. As shown when the earlobe guards 15 of the earring support device 10 are closed, a pin 40 of an earring 35 aligns with, and can be inserted through the apertures 20 of the support device 10.

Figure 4A:
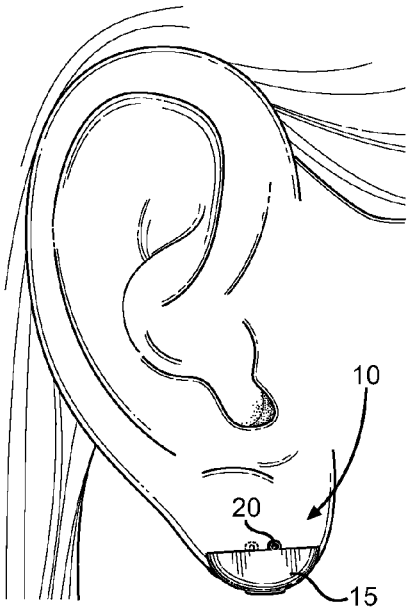
FIG. 4A illustrates a perspective view of the preferred embodiment of the present invention clipped on an ear of a user.

In FIG. 4A, there is shown the preferred embodiment in use by a person. The earring support device 10 is shown placed on the bottom of the earlobe of a user. The clam-shell shaped guards 15 can be gently pulled apart against the force of the hinge and placed on either side of an earlobe. Releasing of the clam-shells 15 on the earlobe traps the earlobe between the shells 15 and holds the clam-shell shaped guards 15 in place under the force of the hinge.

Figure 4B:
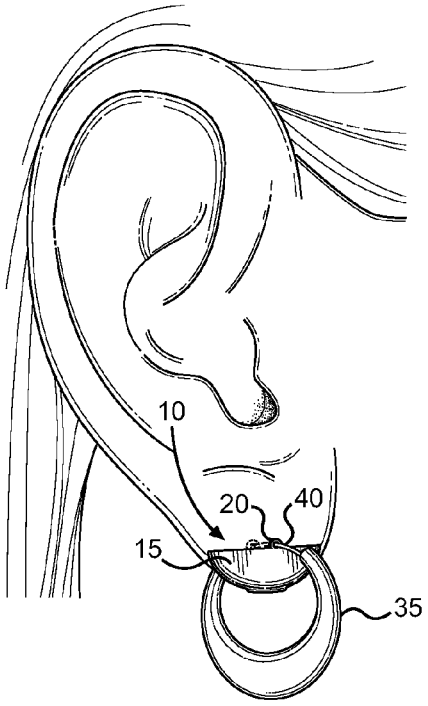
FIG. 4B illustrates a perspective view of the preferred embodiment of the present invention in use with an earring.

FIG. 4B shows the device of the present invention used in conjunction with an earring 35. As shown previously in FIG. 3, the earring aligns with the apertures 20 of the earring support device 10. The device is used by first securing the earring support device 10 onto the earlobe by gently pulling apart the two clam-shell shaped guards 15 and releasing them on the earlobe. The spring force of the hinge draws the two sides towards each other and affixes the guards 15 on either side of the earlobe.

The earring support device 10 is used in conjunction with an earring 35 by first aligning the clam-shell shaped guards 15 and the apertures 20 of the support device with an established piercing of the user. The pin 40 of the earring 35 is then inserted through a first aperture 20, through the piercing, and exits through the aperture 20 on the opposite side of the support device 10.

The earring support device 10 of the preferred embodiment lessens the weight impact of the jewelry on an ear piercing. The support device 10 accomplishes this because the earlobe guards 15 are secured to the earlobe and not the piercing. Therefore the jewelry which is attached to the support device 10 is supported by the lower earlobe instead of just the piercing, and the weight of the jewelry is distributed throughout the earlobe and the pressure that the jewelry places on an earlobe is relieved by the earlobe and the earring support device 10.

Extended use of heavy jewelry on the earlobes can cause the piercing to enlarge, stretch out, or become elongated. The earring support device 10 serves an additional purpose of concealing the effects caused onto an ear piercing by the extended wearing of heavy jewelry prior to the use of the present invention. The clam-shell shaped earlobe guards 15 and apertures 20 of the earring support device 10 cover an area from the piercing to the bottom of the earlobe. Thus, the support device 10 conceals the elongated slit, or stretched hole of a piercing from view when the device is properly attached on the earlobe.

The earring support device can be made of a metal or hard plastic that is suitable for placement against a user's skin and the earring support device 10 can further comprise a variety of decorative designs or colors on the clam-shell shaped earlobe guards and apertures to match the user's skin tone, clothing, earrings, or personal style.

The present invention provides a new and improved earring support device 10 for providing relief to an ear piercing from the extended use of heavy jewelry. The earring support device 10 comprises a set of clam-shell shaped earlobe guards 15 that cover a bottom portion of an earlobe, a hinge 25 that biases the earlobe guards 15 towards each other, and apertures that align with a user's existing piercing. The support device 10 clamps onto the bottom of an earlobe and is secured thereto, wherein a pin 40 of an earring 35 is placed through the apertures 20 of the support device 10 and is supported by the device 10 and the earlobe. The weight of the jewelry is distributed throughout the support device 10 and earlobe instead of the piercing alone and the support device 10 further serves to conceal the effects of prior extended use of heavy jewelry by covering the lower earlobe. The device 10 can comprise a metal or suitable plastic and can come in a variety of colors and designs to fit the needs of the user.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An earring support device comprising:

a pair of earlobe guards in the form of a first half clamshell and a second half clamshell;

each of said first half clamshell and said second half clamshell having a substantially straight upper edge and a curved bottom edge, defining a substantially semicircular shape;

a hinge joining said first half clamshell and said second half clamshell along said bottom edge of each of said first half clamshell and said second half clamshell; and said upper edge of each of said first half clamshell and said second half clamshell being attached to an eyelet, the eyelet defining an aperture; wherein said aperture on said first half clamshell and said aperture on said second half clamshell align with each other and are adapted to receive a pin of an earring.

2. The earring support device of claim 1, wherein said hinge is located on an interior of said bottom edge of each of said first half clamshell and said second half clamshell and biases said pair of earlobe guards to a closed position.

3. The earring support device of claim 2, wherein said pair of earlobe guards are sized and configured for attachment onto an earlobe.

4. The earring support device of claim 1, wherein said upper edge to said bottom edge span from a piercing of an ear to a bottom of an earlobe when in use.

5. The earring support device of claim 1, wherein said hinge is spring-biased.

6. The earring support device of claim 1, wherein said eyelet is located at a substantial midpoint of said upper edge.

7. The earring support device of claim 1, wherein said first half clamshell and said second half clamshell are identical in shape and size.

* * * * *